US007549910B2

(12) United States Patent
Stanley

(10) Patent No.: US 7,549,910 B2
(45) Date of Patent: Jun. 23, 2009

(54) BLADE SHARPENING HOLDER

(76) Inventor: Harrelson Stanley, 51 Shattuck St., Pepperell, MA (US) 01463

( * ) Notice: Subject to any disclaimer, the term of this patent is extended or adjusted under 35 U.S.C. 154(b) by 15 days.

(21) Appl. No.: 12/015,200

(22) Filed: Jan. 16, 2008

(65) Prior Publication Data

US 2008/0113591 A1 May 15, 2008

Related U.S. Application Data

(63) Continuation-in-part of application No. 11/530,988, filed on Sep. 12, 2006, now Pat. No. 7,335,093.

(51) Int. Cl.
*B24B 7/19* (2006.01)

(52) U.S. Cl. ..... 451/45; 451/170; 451/365; 451/367; 451/370; 451/371

(58) Field of Classification Search ..... 451/45, 451/170, 365, 367, 370, 371
See application file for complete search history.

(56) References Cited

U.S. PATENT DOCUMENTS

| | | | | |
|---|---|---|---|---|
| 103,739 | A | 5/1870 | Hanks | |
| 1,239,494 | A * | 9/1917 | Lange | 451/370 |
| 3,654,823 | A | 4/1972 | Juranitch | |
| 3,800,632 | A | 4/1974 | Juranitch | |
| 3,950,899 | A * | 4/1976 | Gilbert | 451/370 |
| 4,070,929 | A | 1/1978 | Risher | |
| 4,512,111 | A | 4/1985 | Childers | |
| 4,512,112 | A | 4/1985 | LeVine | |
| 4,733,501 | A | 3/1988 | McLean | |
| 4,736,544 | A | 4/1988 | Greenquist | |
| 5,195,275 | A | 3/1993 | McLean | |
| 5,431,068 | A | 7/1995 | Alsch | |
| 5,462,476 | A | 10/1995 | Bohn | |
| 5,472,375 | A | 12/1995 | Pugh | |
| 5,527,208 | A | 6/1996 | Blake et al. | |
| 6,030,281 | A | 2/2000 | Cozzini et al. | |
| 6,146,257 | A | 11/2000 | Himeno et al. | |
| 6,168,509 | B1 | 1/2001 | Presgrove | |
| 6,942,551 | B2 | 9/2005 | Mizek et al. | |

* cited by examiner

*Primary Examiner*—Joseph J Hail, III
*Assistant Examiner*—Shantese McDonald
(74) *Attorney, Agent, or Firm*—Robert R. Deleault, Esq.; Mesmer & Deleault, PLLC

(57) ABSTRACT

A sharpening holder for manually-sharpening a cutting edge to be honed over a honing surface includes a cylindrical body having a first end, a second end and an opening formed through the body between the first end and the second end, the opening having a tool support surface, an adjustable clamping component having a rotatable fastening plate positioned within the opening wherein the fastening plate has a tool engaging surface to hold the tool against the tool support surface and a top surface with skew angle indicia, and a plurality of roller members disposed within a longitudinal raceway formed in a lower portion of the body below the opening wherein the plurality of roller members are aligned parallel to the longitudinal axis of the cutting edge to be sharpened and wherein the axis of rotation of the plurality of roller members is perpendicular to the longitudinal axis of the cutting edge to be sharpened.

20 Claims, 10 Drawing Sheets

BLADE SHARPENING HOLDER

This application is a Continuation-in-Part application of Ser. No. 11/530,988, filed on Sep. 12, 2006.

BACKGROUND OF THE INVENTION

1. Field of the Invention

The present invention relates generally to tool holders. Particularly, the present invention relates to blade sharpening holders. More particularly, the present invention relates to honing guides and tool grinding rests.

2. Description of the Prior Art

When sharpening a cutting edge on a tool, it was common to use jigs to hold the tool to be sharpened at a predetermined angle to a grind stone. Typically, the grind stones were water cooled. The grinding jigs usually included a roller which supported a plate upon which the tool was secured. The support plate and roller held the tool at a selected angle against the stone surface. As the stone was moved, the cutting edge was ground to the selected angle. The initial setting of the tool in the jig was critical to the success of the operation.

The present use of such guides is now customarily limited to flat bench stones. The skilled artisan, however, differentiates between grinding and honing. Grinding is considered as defining the basic edge and honing as refining the basic edge to the finished sharp edge. In the normal sharpening process, the edge to be sharpened is initially passed over the coarse stone at a selected angle. This process leaves a ragged edge of the desired angle. The bevel is then refined over a stone of finer particles. Since such stones cut more slowly, the work is done on the part of the bevel which intersects with the face of the tool to provide a micro-bevel.

The micro-bevel selected should be a function of the tool material, the material to be cut and the intended use. Ideally, the bevel angle should be no greater than is necessary to prevent the edge from breaking down so that the wedging action of the tool is minimized as the edge enters the material to be cut.

When manually sharpening a tool's cutting edge, the skilled artisan uses a variety of methods including oil stones, water stones, sandpaper, loose grit or paste on glass, etc. Honing stones are typically rectangular shaped. When using an oil stone, typically a small amount of honing oil, which is a lightweight oil, is usually placed on the honing stone. The skilled artisan then pulls or pushes the cutting edge over the honing stone at the desired angle as if the cutting edge were scrapping the surface of the honing stone, i.e. the cutting edge is pushed or pulled over the honing surface in a perpendicular fashion. Several blade holders to facilitate manual sharpening of a cutting edge over a honing surface have been devised.

U.S. Pat. No. 4,733,501 (1988, McLean) discloses a honing guide. The honing guide includes a tool support plate mounted above a surface-engaging roller. The surface engaging roller is mounted eccentrically so that the height of the tool support plate may be varied to provide a range of honing angles without unclamping the tool from the guide.

U.S. Pat. No. 5,472,375 (1995, Pugh) discloses a blade sharpening angle guide. The blade sharpening guide includes an elongated curved block having a longitudinal slot therethrough. The longitudinal slot releasably holds a knife blade with the blade cutting edge extending a distance outside the slot.

U.S. Pat. No. 6,030,281 (2000, Cozzini et al.) discloses a sharpening apparatus. The sharpening apparatus includes a base member on which a sharpening stone is positioned. A slidable blade guide member is slidably connected to the base member and includes a guide surface that is disposed at an angle relative to the upper surface of the sharpening stone and a mounting mechanism for removably mounting a spatula against the guide surface such that the scraping edge of the spatula is in engagement with the sharpening stone. The slidable blade guide member is manually slidable back and forth to sharpen the scraping edge of the spatula. A fixed blade guide member is also attached to the base member. The fixed blade guide member includes a horizontal slot that is adapted to receive the shaft of a grill scraper. The fixed blade guide member is adapted to provide guided back and forth sliding movement of the grill scraper within the slot and engagement with the sharpening member to sharpen the scraping edge of the grill scraper.

The above-described devices require the cutting edge of the tool to move over and against the sharpening/honing stone in a "scraping" motion. In other words, the motion of the cutting edge to the stone surface is similar to the action used with a scraper/tool. The motion of the cutting edge of the cutting tool against the honing stone surface is perpendicular to the longitudinal axis of the cutting edge. A disadvantage of this type of action is that the honing stone surface develops a concave shape with use thus shortening the useful life of the honing stone. Another disadvantage is that the concave surface of the honing stone produces a cutting edge that is inconsistent since the cutting edge angle changes as the cutting edge moves through the concavity in the stone surface. Yet another disadvantage is that only a portion of the honing stone is used since the holder must be on the stone at the beginning of the honing process in order to insure that the cutting edge is positioned correctly relative to the honing surface.

Therefore, what is needed is a sharpening holder for use in manually sharpening a cutting edge that does not cause the development of a concave surface in the honing stone with extended use. What is further needed is a sharpening holder that allows the use of substantially the entire surface area of the honing stone. What is also needed is a sharpening holder that does not use a "scrapping" action of the cutting edge over the honing surface in order to sharpen the cutting edge.

SUMMARY OF THE INVENTION

It is an object of the present invention to provide a sharpening holder that allows a user to use substantially the entire surface area of the honing stone surface when manually honing a cutting edge. It is another object of the present invention to provide a sharpening holder that does not cause the development of a concave honing surface in a honing stone when a cutting edge is sharpened using the sharpening holder. It is a further object of the present invention to provide a sharpening holder that does not rely on "scrapping" the cutting edge into the honing surface to achieve sharpening of the cutting edge.

The present invention achieves these and other objectives by providing a sharpening holder that has a body, an adjustable clamping component, and a plurality of roller members. In one embodiment of the present invention, the body has a first end, a second end and an opening through the body between the first end and the second end, and the opening has a tool support surface. The adjustable clamping component has a fastening plate positioned within the opening of the body. The fastening plate has a tool engaging surface to hold the tool to be sharpened against the tool support surface of the body. The plurality of roller members are attached to a lower portion of the body below the opening and adjacent the second end where the plurality of roller members are configured to allow the body to roll sideways on the honing surface causing the cutting edge to move parallel to the honing surface instead of perpendicular to the honing surface. More specifically, the axis of rotation of the plurality of roller members is perpendicular to the longitudinal axis of the cutting edge to be sharpened. The plurality of roller members may also be configured to allow the body to roll through an arc on the honing surface to provide "parallel" like sharpening of a curved cutting edge.

The adjustable clamping component also includes an adjustable fastener for holding the fastening plate against the tool/blade inserted in the opening of the body. The plurality of roller members is attached to a lower portion of the body below the opening and adjacent the second end of the body. The plurality of roller members may be permanently attached or, preferably, removably attached. Optionally, a raceway may be used to house the plurality of roller members. The raceway is preferably formed at an angle to the bottom of the body and may be incorporated into a body extension that extends below the body adjacent the second end. It should be noted that the use of a raceway is optional, especially when wheels or cylindrical rollers or tapered rollers are used since these could be attached to an angled surface on the bottom of the body or at the second end of the body. If a body extension is used, the body extension may be integrally formed with the body or may be a separate component that is attached to the body.

In another embodiment of the present invention, the body is cylindrically shaped with an elongated recess or an elongated opening that extends along a major portion of cylindrical body. The elongated recess or elongated opening has a cutting tool receiving surface with an adjustable clamping mechanism that includes a fastening plate or a plurality of tool fasteners such as, for example, hold-down screws for securely and removably holding a cutting blade in the body of the sharpening holder. A plurality of roller members are rotatably connected in a raceway formed into the surface of the body in a longitudinal direction. The raceway is formed at an angle to the cutting tool receiving surface. The rotational axis of the plurality of roller members is perpendicular to the raceway, which is also perpendicular to the cutting edge of a cutting blade mounted in the sharpening holder so that the rolling direction of the plurality of roller members is paralleled to the longitudinal axis of the cutting edge.

In the embodiment with an elongated opening, the fastening plate of the adjustable clamping mechanism includes a plurality of through openings along the peripheral ends that are sized to receive skew angle pins. The plurality of through openings are located to provide a preset or indexed skew angle for a tool blade having a cutting edge with a skew angle. The bottom surface of the fastening plate has a concave V-shape to more easily align various sizes and shapes of cutting tools. The top surface of the fastening plate also includes a plurality of skew angle indicia disposed onto is formed into the top surface. The skew angle indicia are also preset or indexed skew angle indicators. Additionally, there is included an optional fine adjustment component, preferably a roller, mounted at an end of the body so that the roller engages the peripheral edge of the fastener plate to allow for fine skew angle adjustment.

An angle dock can optionally be included in any embodiment of the present invention. The angle dock for the embodiment of the sharpening holder having a cylindrical body is a docking plate with one end being thicker than the rest of the plate. The thicker end has a curved surface shaped to accommodate the cylindrical surface of the sharpening holder and a channel formed into the surface of the plate next to the curved surface. The docking channel extends the width of the docking plate parallel to the curved surface. The docking channel is sized to accommodate the plurality of roller members of the sharpening holder while the curved surface of the angle dock accommodates the cylindrical surface of the body of the sharpening holder. Disposed on the surface of the angle dock and spaced from the docking channel is a plurality of parallel linear indicia positioned to index specific cutting edge angles. The angle dock is used to accurately position in the sharpening tool of the present invention a particular cutting blade with a predefined cutting edge angle to provide the correct honing angle for sharpening. For example, a cutting blade having a 30° cutting edge angle is placed in the tool so that the cutting edge of the cutting tool extends from the sharpening tool. The longitudinal edge of the cutting edge is aligned with the 30° angle indicator on the angle dock. Once aligned, the clamping mechanism is tightened to lock the blade into the sharpening tool for honing of the cutting edge. Although a cutting tool may be positioned in the sharpening tool and secured thereto with the adjustable clamping mechanism so that the cutting edge extends the approximate distance away from sharpening holder for the desired cutting edge honing angle, the angle dock makes setting the cutting edge easier and more accurate.

Another optional feature of the present invention includes a sharpening holder sled. The sled is used to slidingly move the sharpening holder over the honing stone surface instead of engaging the plurality of roller members. Preferably, the sled has one or more sled ears that are integrally connected to the sled and extends away from a top surface of the sled. The sled ear has a through opening sized to accommodate an axle of a roller member. The sled ear is also preferably sized to replace a single roller member. This allows the use of the sled by removing only a quantity of roller members from the raceway of the body equal to the number of sled ears on the sled. The sled ear also preferably extends sufficiently so that the remaining roller members may or may not be removed from the body of the sharpening holder without affecting the use of the sled. The sled lets a user move the sharpening holder in a parallel and oblique sliding motion along its longitudinal axis, which is parallel to the longitudinal axis of the cutting edge, over the honing stone; a motion that is more difficult to do with the plurality of roller members. It should be noted that the sled may also be configured as a slide bar that is insertable within the raceway. The slide bar may also be formed as part of the body with a special coating or layer attached to the surface of the slide bar that allows the body to slide over a honing surface without extensive wear to the slide bar. In the insertable sled/side bar embodiment, the sled/side bar may have a simple shape such as a rectangular block that is insertable into the raceway of the body. The roller members would be completely removed and the sled inserted into the raceway and secured. The sled extends out of the raceway approximately the same distance as the roller members. The portion of the sled that extends out of the raceway may also be wider than the raceway.

The unique feature of the present invention in all its embodiments is the ability to sharpen the cutting edge of a blade or tool using a sideways motion with the sharpening holder that is parallel to the cutting edge of the blade or tool when manually sharpening a tool on a stationary honing stone surface, called herein as a "parallel sharpening motion." In other words, the rotational axes of the roller members are perpendicular to the longitudinal axis of the cutting edge. The prior art devices require a sharpening motion that is perpendicular to the cutting edge and, those prior art devices that use roller members, the rotational axis of the roller members of the prior art is parallel to the cutting edge of the cutting tool. The parallel sharpening motion has the added advantage that it does not create a concavity in the honing stone surface with use over time like that created by prior art devices.

Another feature of the present invention is the relationship of the cutting edge of a tool/blade mounted in the body to the plurality of roller members. The plurality of roller members is positioned preferably at a predetermined angle to the bottom of the body so that the distance between the cutting edge to be sharpened and the points of contact of the roller members with the honing stone surface is less than one-half the width of the honing stone. This feature provides another advantage of the present invention in that it allows sharpening over substantially the entire honing stone surface.

DETAILED DESCRIPTION OF THE PREFERRED EMBODIMENT

Figure 1:
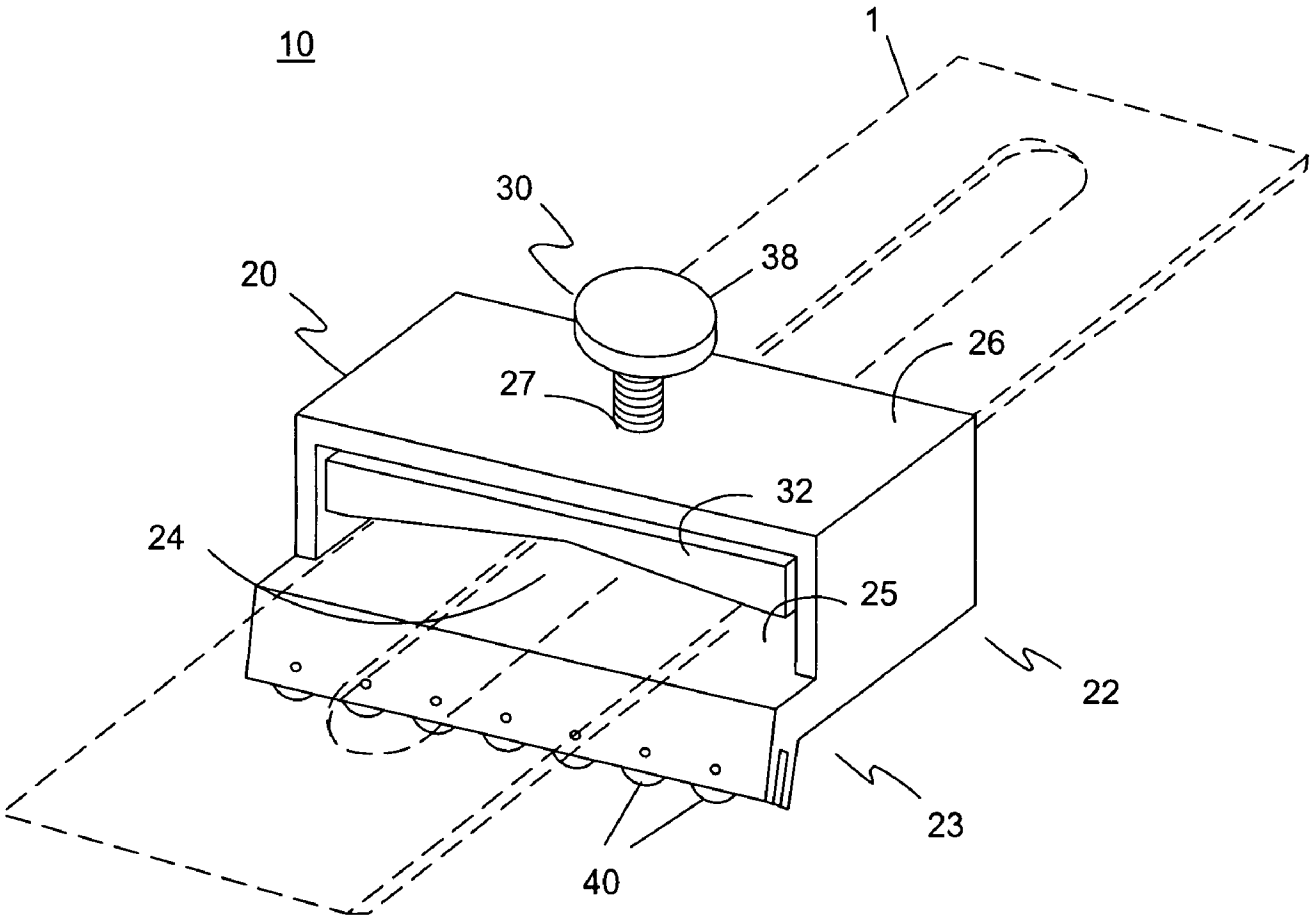
FIG. 1 is a perspective view of one embodiment of the present invention.

The preferred embodiments of the present invention are illustrated in FIGS. 1-19. FIG. 1 shows the sharpening holder 10 of the present invention with one type of blade 1 mounted for sharpening. Sharpening holder 10 has a body 20, an adjustable clamping component 30, and a plurality of roller members 40. Body 20 has a first end 22, a second end 23 and an opening 24 through body 20 between first end 22 and second end 23. Body 20 also includes a tool support surface 25 within opening 24.

Adjustable clamping component 30 includes a fastening plate 32 and an adjustable fastener 38. Adjustable fastener 38 engages fastening plate 32 and imparts a holding force so that fastening plate 32 secures the cutting blade 1 to the tool support surface 25. Although various adjustable fasteners may be used to engage fastening plate 32, adjustable fastener 38 is preferably a thumb screw that engages fastening plate 32 through a threaded opening 27 in a top surface 26 of body 20.

The plurality of roller members 40 are connected to a lower portion 28 of body 20 below opening 24 and adjacent to second end 23. Each of the plurality of roller members 40 are freely rotatable and are aligned to provide body 20 with a sideways rolling action. Roller members 40 that are usable in sharpening holder 10 include wheels, ball bearings, cylindrical rollers, tapered rollers, and the like. An important feature of the plurality of roller members 40 is that the roller members 40 must be sufficiently exposed to allow body 20 to not only roll sideways but also to allow body 20 to pivot through a selected angular range with the pivot point being the points of contact of the roller members 40 with a honing surface of a honing stone (not shown). It should be understood that second end 23 of body 20 may extend to up to and beyond roller members 40 a reasonable distance, if desired, without affecting the functionality of the present invention.

Figure 2:
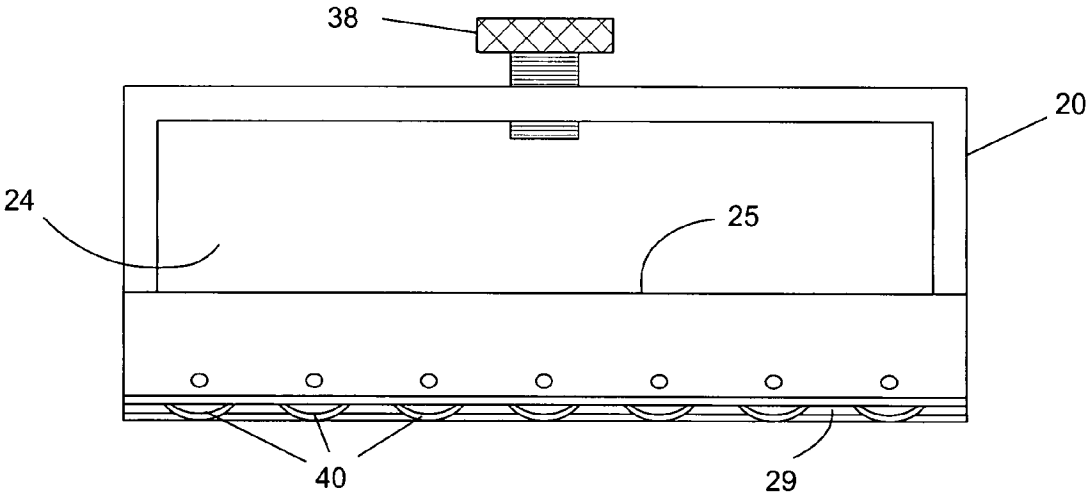
FIG. 2 is a front view of the present invention showing the blade receiving opening in the body of the sharpening holder with the plurality of roller members.

Turning now to FIG. 2, there is illustrated a front view of the present invention. Opening 24 of body 20 and fastening plate 32 may be sized to accommodate a variety of blades and tools having a cutting edge. The plurality of roller members 40 are positioned within a raceway 29 that extends along the width of body 20. The number of roller members 40 connected to body 20 depends on the size of the roller members 40 and the size of body 20, which, in turn, is dependent on the type and size of the blade or tool with a cutting edge that is going to be sharpened and the size of the honing stone surface. The width of body 20 should be shorter than the sharpening surface to allow sufficient sideways sharpening motion. The number of roller elements 40 used is chosen to provide stability to body 20 when it is engaged with the sharpening surface in the sideways sharpening motion. In the preferred embodiment, wheels are the roller members of choice.

Figure 3:
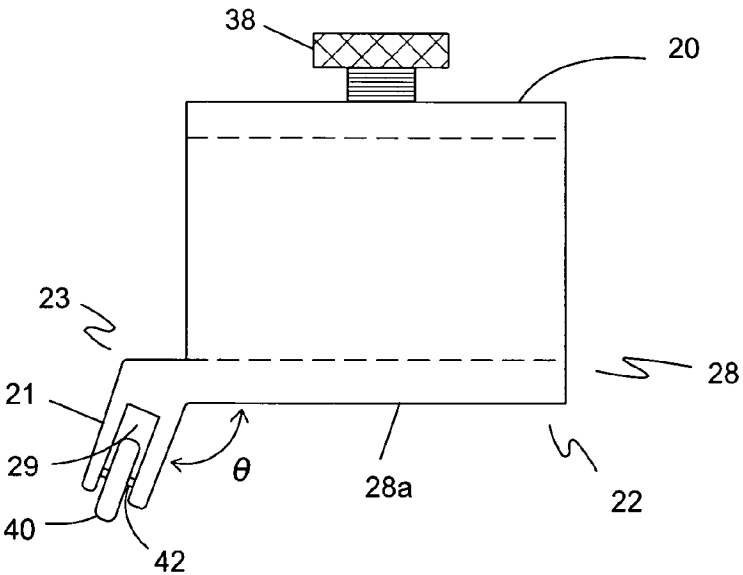
FIG. 3 is a side view of the present invention showing the body and roller members.

FIG. 3 shows a side view of sharpening holder 10. As can be seen, the preferred embodiment has body 20 with a body extension 21 that extends from lower portion 28 below opening 24 adjacent second body end 23. Raceway 29 is located in body extension 21. Each roller member 40 is supported by an axle 42 and all roller members 40 protrude out of raceway 29 a predefined distance. Body extension 21 is structured to have a preset angle θ relative to the bottom 28*a* of body 20. Angle θ is preferably in the range of about 105° to about 125°. Even though body extension 21 is shown as being integral to body 20, body extension 21 may be a separate component that is attached to body 20.

It is important to note that body 20 does not require the use of body extension 21. Raceway 29 could easily be formed into bottom 28*a* adjacent second end 23 at the preset angle θ. The only difference is that body 20 would be slightly heavier due to a thicker bottom portion 28 in order to accommodate raceway 29.

Figure 4:
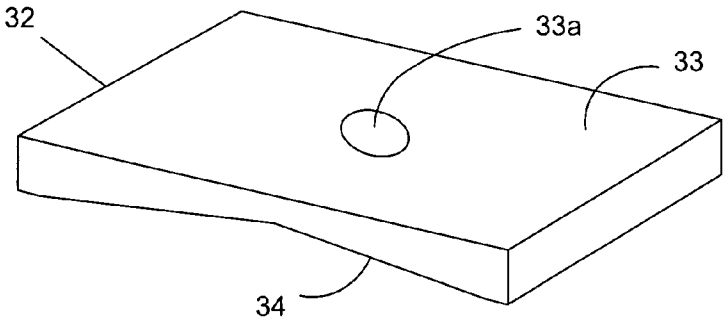
FIG. 4 is a perspective view of the present invention showing the fastening plate of the adjustable clamp component.

Turning now to FIG. 4, there is illustrated a perspective view of fastening plate 32. Fastening plate 32 is sized to fit within opening 24 with the blade/tool to be sharpened. Fastening plate has a top plate surface 33 and a bottom plate surface 34. Top plate surface 33 is engaged by adjustable fastener 38 while bottom plate surface 34 is the tool engaging surface to secure the blade or tool within the sharpening holder 10.

Figure 5:
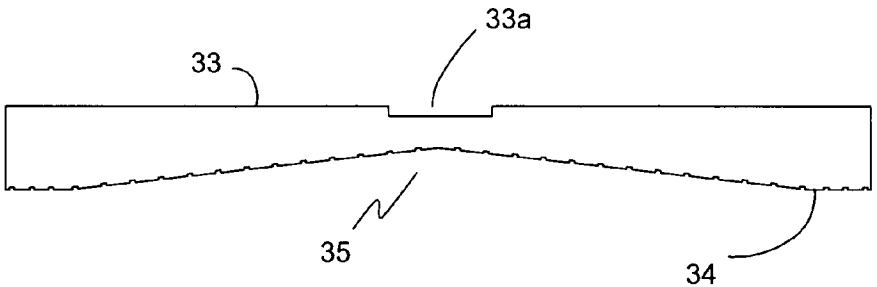
FIG. 5 is a side view of the present invention showing the fastening plate and the concave tool-engaging surface.

FIG. 5 is a side view of fastening plate 32 shown in FIG. 4. Top plate surface 33 includes an optional fastener recess 33*a* for receiving the engaging end of adjustable fastener 38. Optional fastener recess 33*a* prevents fastening plate 32 from inadvertently sliding while engaged by adjustable fastener 38, especially when a blade/tool is being sharpened. Bottom plate surface 34 also includes an optional tool engaging recess 35, which is preferably a V-shaped recess formed in bottom plate surface 34. Similar in purpose to optional fastener recess 33*a*, tool engaging recess 35 prevents the blade/tool from slipping sideways when the sharpening is being performed. Bottom plate surface 34 may also include a plurality of optional bottom plate grooves or parallel steps 34*a*, which are more clearly shown in FIG. 6 and FIG. 6A.

Figure 6:
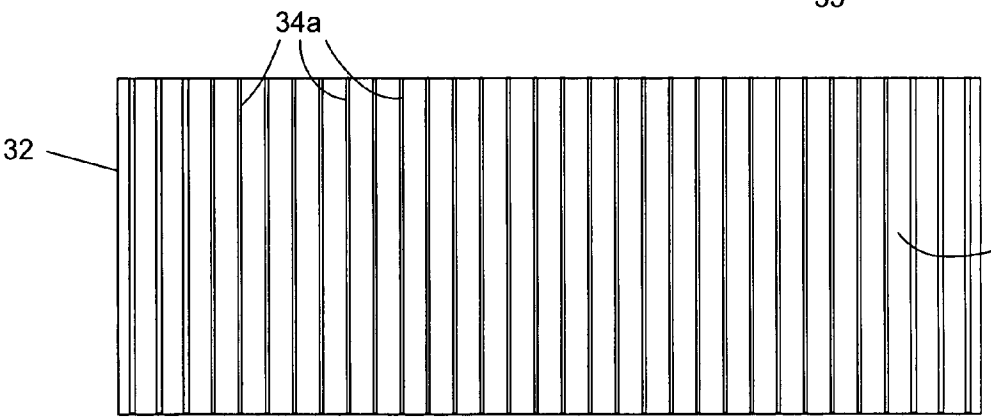
FIG. 6 is a bottom view of the fastening plate of the present invention showing the plurality of tool-holding grooves in the tool-engaging surface.
Figure 6A:
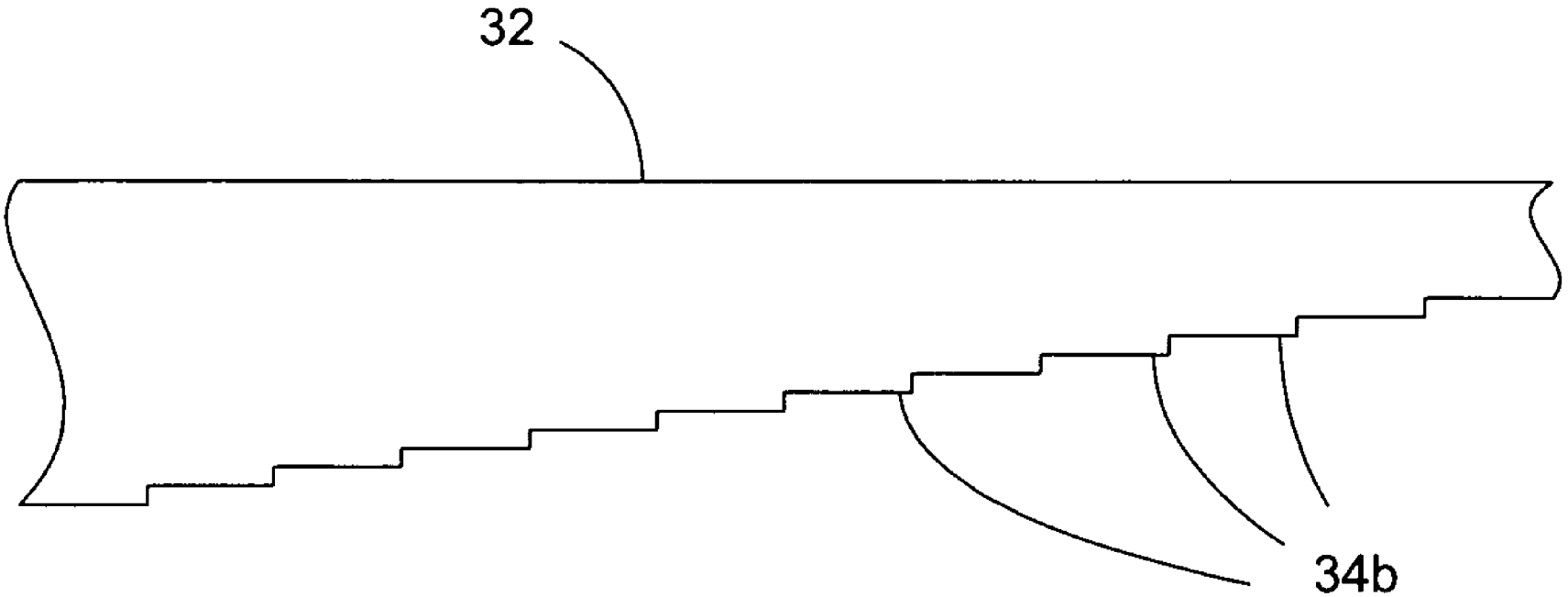
FIG. 6A is an enlarged side view of a portion of the bottom of the fastening plate of the present invention showing the plurality of tool-holding steps in the tool-engaging surface.

Turning now to FIG. 6, there is shown a bottom view of fastener plate 32. Bottom plate surface 34 has a plurality of optional bottom plate grooves 34*a*, which are preferably formed in bottom plate surface 34. Optional bottom plate grooves 34*a* also enhance the holding capability of fastener plate 32. The edges of the blade/tool to be sharpened preferably rest within the bottom plate grooves 34*a*, which further restricts any sideways movement of the blade/tool being sharpened. It has been found that the preferred spacing of optional bottom plate grooves 34*a* is 1/32 in. FIG. 6A illustrates an enlarged side view of a portion of the bottom plate surface 34 with a plurality of parallel steps 34*b*.

Figure 7:
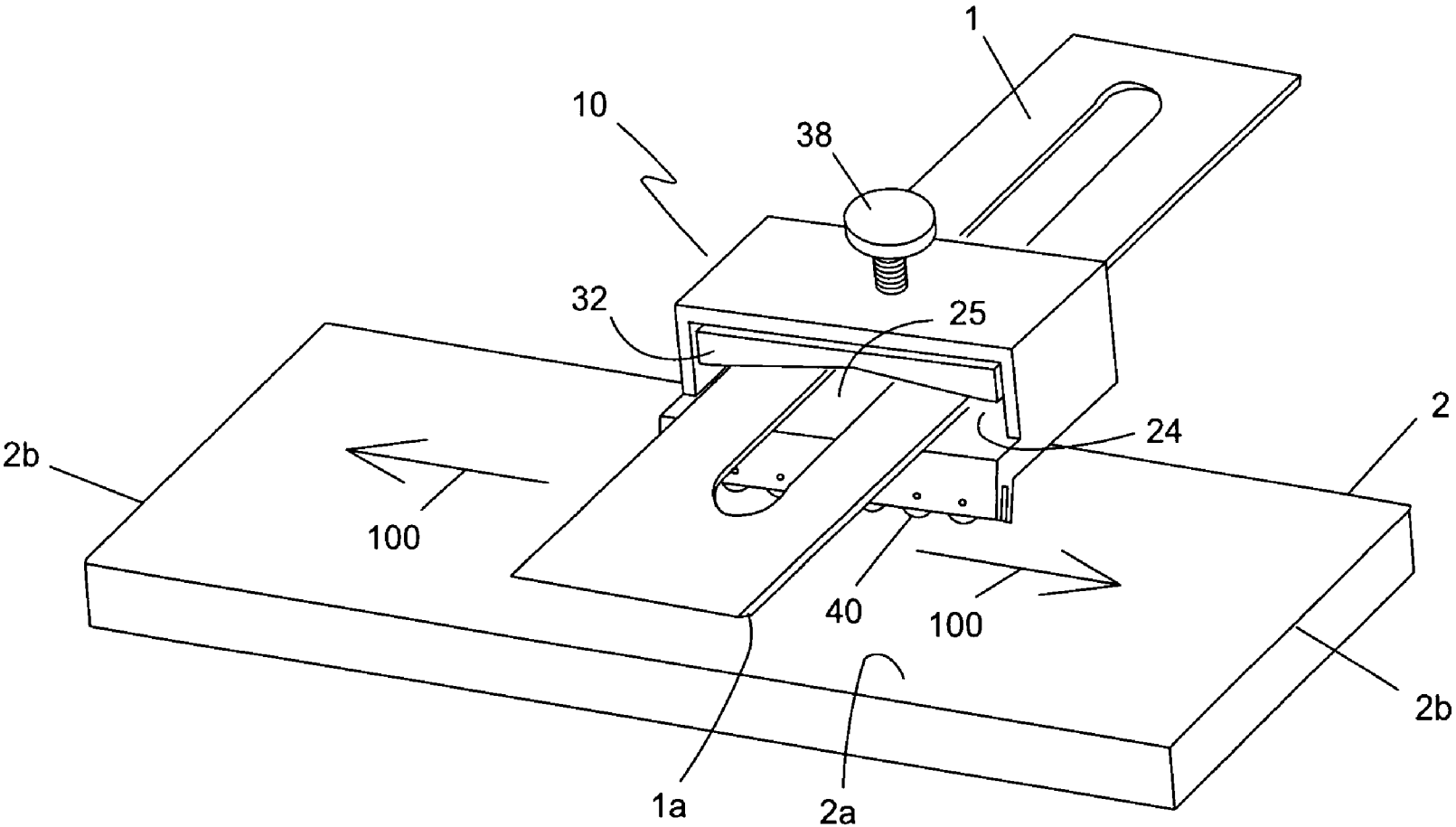
FIG. 7 is a perspective view of the embodiment of the present invention in FIG. 1 showing the positioning of the sharpening holder with a cutting edge on a honing surface.

FIG. 7 illustrates the use of the present invention with a planing blade 1 mounted in sharpening holder 10 on a honing surface 2*a* of a honing stone 2. Planing blade 1 is placed through opening 24 below fastening plate 32 so that blade 1 rests upon tool support surface 25 with the bevel cutting edge 1*a* facing towards the honing stone surface 2*a*. The blade 1 and sharpening holder 10 are adjusted so that cutting edge 1*a* contacts honing stone surface 2*a*. Fastener 38 is then turned to secure blade 1 in sharpening holder 10. Once secured, sharpening of blade 1 is accomplished by rolling the sharpening holder 10 with the cutting edge 1*a* on honing stone surface 2*a* in the directions indicated by arrows 100.

Unlike prior art hand or manual sharpening tools and jigs, the present invention moves the cutting edge 1*a* in a motion that is parallel to the cutting edge 1*a* and not perpendicular. More specifically, the axis of rotation of the plurality of roller members is perpendicular to the longitudinal axis of the cutting edge to be sharpened. The advantage of the sharpening holder 10 and its method of sharpening is that the entire honing stone surface 2*a* can be used. Cutting edge 1*a* can be moved to and beyond the edges 2*b* of honing stone 2 without sharpening holder falling off of honing stone 2. This motion and sharpening technique also eliminates the formation of a concavity in the honing stone surface 2*a*. In fact, it is typical that the honing stone surface 2*a* will develop a slight convex nature when tool sharpening is performed using a sharpening holder of the present invention, which is not detrimental to the cutting edge 1*a* or the useful life of the honing stone. In fact, this "parallel" sharpening technique lengthens the useful life of the honing stone compared to stones where a sharpening jig that relies on a "perpendicular" sharpening technique is used.

Figure 8:
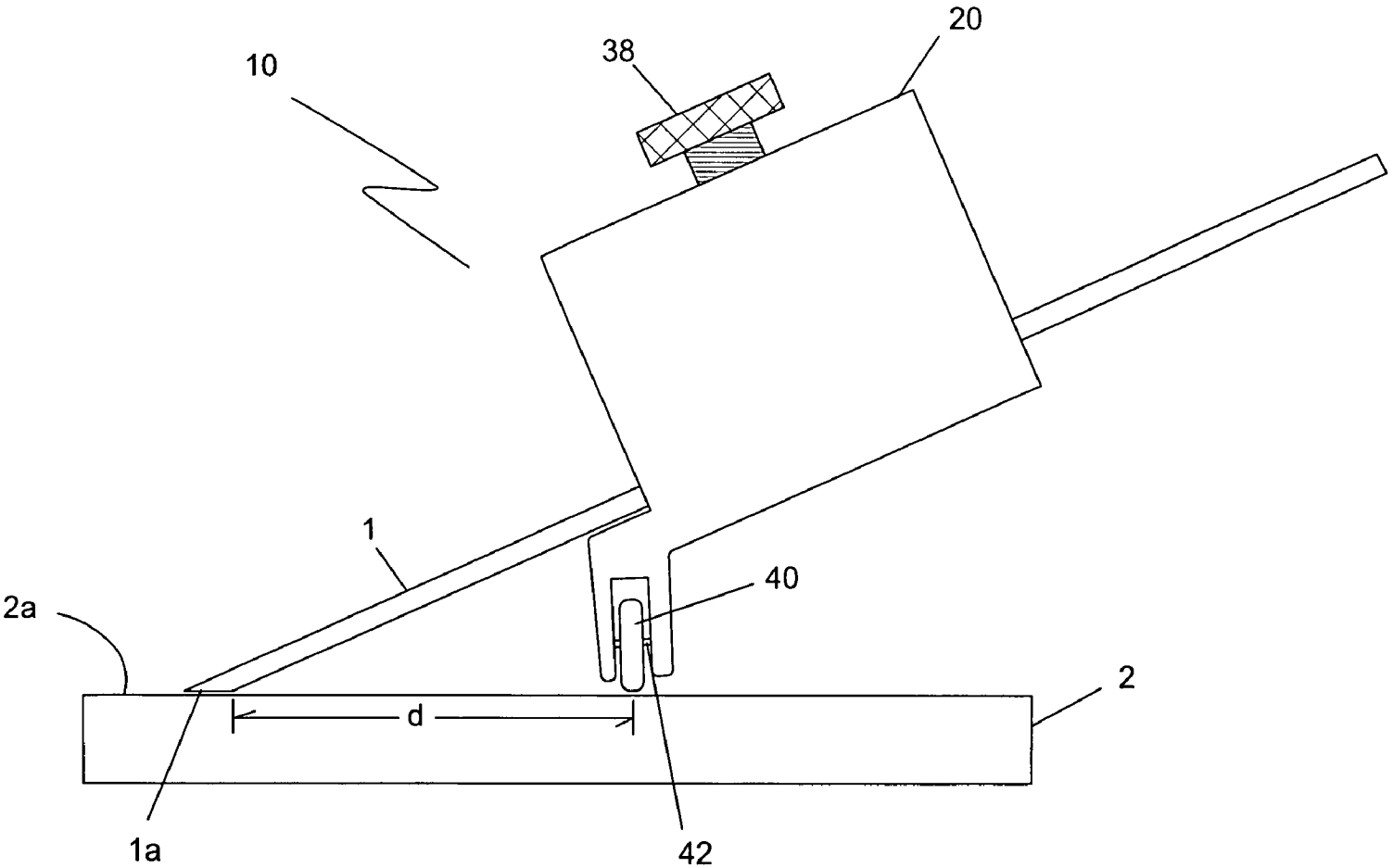
FIG. 8 is a side view of the embodiment of the present invention in FIG. 7 showing the positioning of the sharpening holder with a cutting edge on a honing surface.

Turning to FIG. 8, there is a side view of the embodiment in FIG. 7. Sharpening holder 10 is pivoted about the contact point of the roller members 40 with honing stone surface 2*a* so that cutting edge 1*a* makes contact with honing stone surface 2*a*. The distance between the cutting edge 1*a* and the plurality of roller members 40 depends on the bevel angle of the cutting edge 1*a*. The bevel angle is normally within a range between a knife blade and a scraper. The range is typically between about 21° (knife edge) and 32° (scraper). For wood planing blades, the bevel angle is about 27°.

As previously mentioned, sharpening holder 10 can be sized for the type of tool or blade that is to be sharpened as well as the size of the honing stone surface. The sharpening holder 10 is preferably structured so that the distance "d" illustrated in FIG. 8 between the plurality of roller members 40 and the cutting edge 1*a* is less that one-half of the honing stone width. This allows the entire surface of the honing stone 1 to be used for sharpening, which in turn allows the entire surface of the honing stone 1 to wear evenly and to avoid the wear concavity caused by prior art sharpening holders and jigs.

It is also noted that the distance the cutting edge 1*a* extends out of sharpening holder 10 can also change the pivoting angle of sharpening holder 10 along the contact points of the plurality of roller members with the honing stone surface 2*a*. This allows the sharpening holder 10 to be used to sharpen blades or tools with cutting edges that differ from one blade or tool to another. The allowed pivoting angle of sharpening holder 10 is directly related to the size of the plurality of roller members 40 as well as the distance the roller members 40 extend from sharpening body 20.

Figure 9:
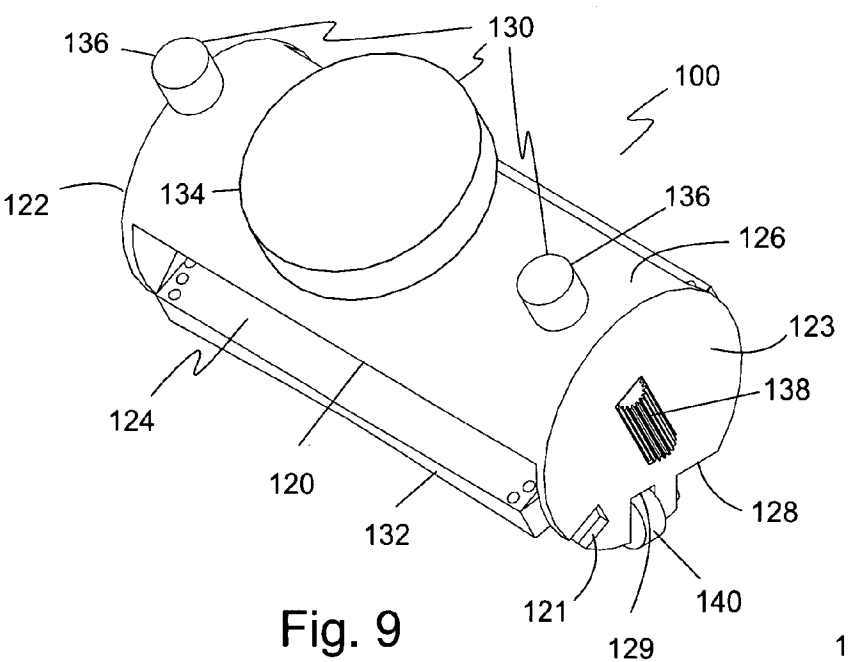
FIG. 9 is a perspective view of another embodiment of the present invention.

Turning now to FIG. 9, there is illustrated another embodiment of the present invention. FIG. 9 shows the sharpening holder 100 of the present invention. Sharpening holder 100 has a body 120, an adjustable clamping component 130, and a plurality of roller members 140. Body 120 has a first end 122, a second end 123 and an opening 124 through body 120 between and orthogonal to first end 122 and second end 123. Adjustable clamping component 130 includes a fastening plate 132, an adjustable fastener 134, skew-indexing fastening plate pins 136, and fine-adjustment component 138 for more accurately setting the cutting tool skew angle. Adjustable fastener 134 engages fastening plate 132 and imparts a holding force so that fastening plate 132 secures a cutting blade to tool holder 100. Although various adjustable fasteners may be used to engage fastening plate 132, adjustable fastener 134 is preferably a thumb screw that engages fastening plate 132 through a threaded opening 127 in an outer circumferential surface 126 of body 120.

The plurality of roller members 140 are connected to a lower portion 128 of body 120 below opening 124. Each of the plurality of roller members 140 are freely rotatable and have an axis of rotation that is perpendicular to the longitudinal axis of body 120 as well as the longitudinal axis of a cutting edge of a tool mounted in sharpening holder 100. As previously disclosed, roller members 140 that are usable in sharpening holder 100 include wheels, ball bearings, cylindrical rollers, tapered rollers, and the like. An important feature of the plurality of roller members 140 is that the roller members 140 must be sufficiently exposed to allow body 120 to not only roll but also to allow body 120 to pivot through an angular range with the pivot point being the points of contact of the roller members 140 with a honing surface of a honing stone (not shown). An optional notch 121 is formed into the body ends 122, 123 for accommodating electric planing blades, which are typically longer along the cutting edge than the width of the blade. Optional notch 121 allows electric planing blades to be mounted in body 120 when the sharpening holder 100 is shorter in the longitudinal direction than the length of the cutting edge of the electric planing blade.

Figure 10:
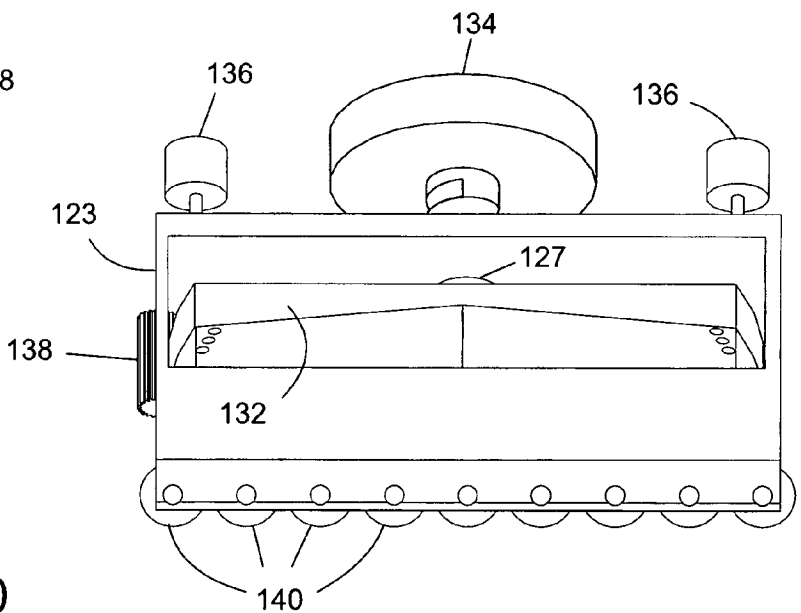
FIG. 10 is a back perspective view of the embodiment shown in FIG. 9.

Turning now to FIG. 10, there is illustrated a rear view of the embodiment of the present invention shown in FIG. 9. Opening 124 of body 120 and fastening plate 132 may be sized to accommodate a variety of blades and tools having a cutting edge. The plurality of roller members 140 are positioned within a raceway 129 that extends along the longitudinal length of body 120. The number of roller members 140 connected to body 120 depends on the size of the roller members 140 and the longitudinal length of body 120, which, in turn, is dependent on the type and size of the blade or tool with a cutting edge that is going to be sharpened and the size of the honing stone surface. For example, opening 124 may be only a recess with a clamping mechanism such as a plurality of hold-down screws to hold a cutting tool such as the cutting blades of an electric or power planing device. As recognized by those of ordinary skill in the art, cutting blades on electric or power planing tools have typically longer cutting edges when compared to their transverse dimension. Thus, the transverse dimension or width of the electric planing cutting blades does not require sharpening holder 100 to have a through opening 124 but simply a recess or clamping slot sufficient to accommodate such cutting blades. The longitudinal length of body 120 should be shorter than the longitudinal honing stone surface to allow sufficient sharpening motion. The number of roller elements 140 used is chosen to provide stability to body 120 when it is engaged with the honing stone surface during the sharpening motion. In the preferred embodiment, wheels are the roller members of choice.

Figure 11:
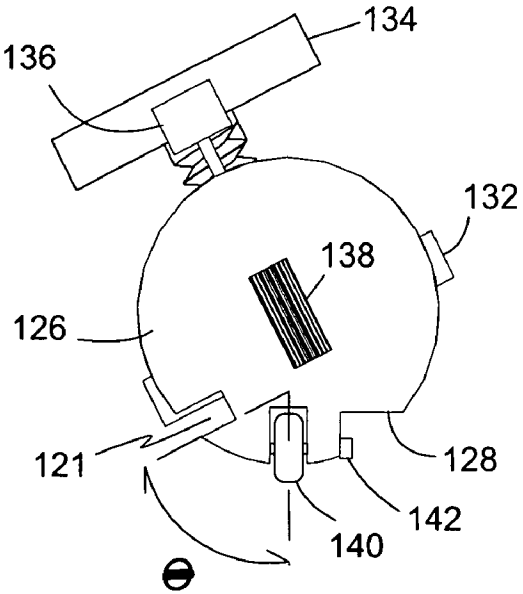
FIG. 11 is a side view of the embodiment shown in FIG. 9.

FIG. 11 is a side view of sharpening holder 100. As can be seen, the preferred embodiment has body 120 with a raceway 129 formed into body surface 126. As shown in this embodiment, an optional ledge 128 is formed parallel to and spaced from raceway 129 in order to provide a substantially flat surface for placement of the plurality of axles 142 that rotatably supports the plurality of roller members 140. It should be understood that cylindrical opening may be formed into the curved surface of body 120 to accommodate the plurality of axles 142 instead of providing the optional ledge 128. Each roller member 140 is supported by an axle 142 and all roller members 140 protrude out of raceway 129 a predefined distance. The plurality of roller members 140 are positioned along body 120 such that the angle of the roller members 140 to the cutting tool support surface has a preset angle θ. Angle θ is preferably in the range of about 55° to about 75°.

Figure 12:
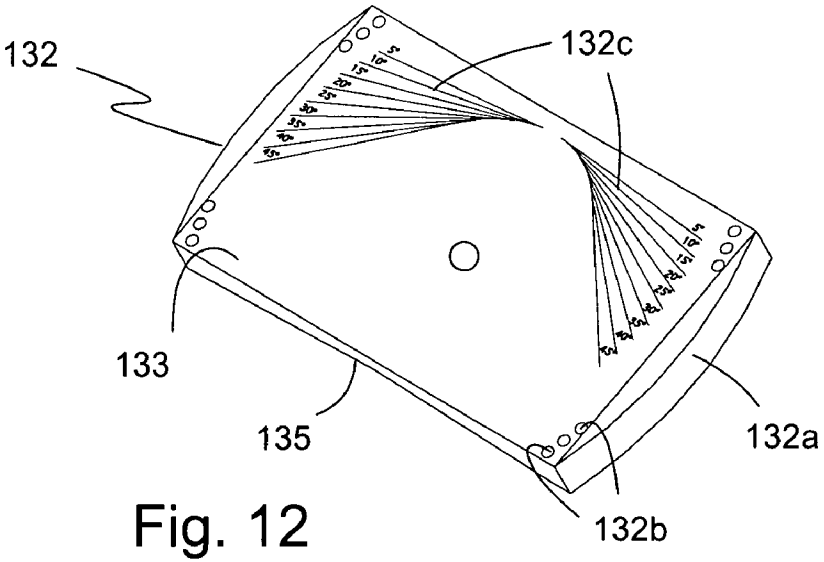
FIG. 12 is a perspective view of fastening plate of the embodiment shown in FIG. 9 showing skew angle selections.
Figure 13:
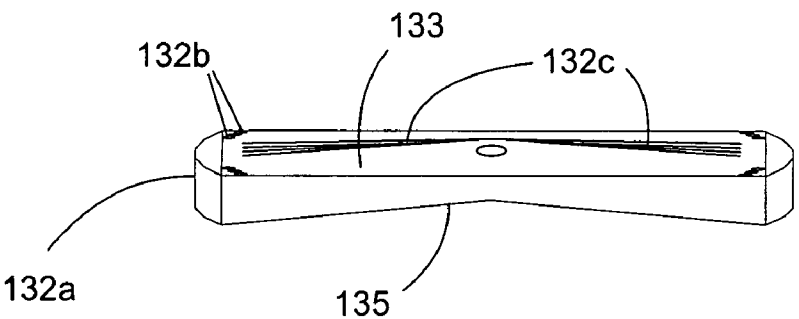
FIG. 13 is a perspective front view of the fastening plate shown in FIG. 12.

Turning now to FIGS. 12 and 13, there is illustrated a perspective view of fastening plate 132. Fastening plate 132 is sized to fit within opening 124 with the blade/tool to be sharpened. Fastening plate 132 has a top plate surface 133 and a bottom plate surface 135. Top plate surface 133 is engaged by adjustable fastener 134 while bottom plate surface 135 is the tool engaging surface to secure the blade or tool within the sharpening holder 100. Bottom plate surface 135 may optionally include the plurality of grooves or steps previously disclosed in FIGS. 6 and 6A.

Fastening plate 132 has several unique features. The features include arc-shaped sides 132*a* along the width of fastening plate 132, a V-shaped bottom plate surface 135 where the vertex of the V-shape extends along the width of the plate, a plurality of through openings 132*b* located along the arc-shaped sides, and a skew-angle scale 132*c* on the top plate surface 133. Arc-shaped sides 132*a* have an arc radius that allows fastening plate 132 to pivot about the rotational axis of adjustable fastener 134. This pivotal rotation coupled with the V-shaped bottom plate surface 135 allows a user to mount a cutting edge having a skew angle on the cutting blade of the tool. The plurality of through openings 132*b* are positioned along the arc-shaped sides 132*a* to provide indexed/preset skew angles such as, for example, 20°, 25° and 30°. The skew-angle scale 132*c* further provides a plurality of skew angle indicia such as, for example, 5° to 45° in 5° increments. The skew angle indicia, which are preferably indicator lines, are positioned to align with the longitudinal edge of the body opening 124. The arc-shaped sides 132*a* also provide a surface against which fine adjustment component 138 frictionally rotates. Fine adjustment component 138 provides the user with means for making fine adjustments to the skew angle for skew angles that lie between the 5° increments. Fine adjustment component 138 is preferably a roller with a frictional surface that is capable of engaging the arc-shaped aide 132*a* to controllably rotate fastening plate 132 to a desired skew angle. The frictional surface has frictional characteristics imparted by the material of the surface or by the surface's shape such as, for example, a geared or toothed surface.

The configuration of fastening plate 132 is extremely versatile such that sharpening holder 100 can be used to sharpen a wide variety of tools. This tool variety includes, but is not limited to, chisel style knives, skew knives (pocket knives), thickness planer blades, power planer blades, skew carving tools, chisels, hand plane blades, straight razors, drill bits, razor blades, micro tools (the present invention can scale down to work on microscopically small tools), narrow chisels, very wide chisels, boat slicks, medical instruments, dental instruments, curets, checkering tools, gun smith tools, surgical instruments, scalpels, scalpels for woodworking, scrapers for painters, putty knives, painters scrapers, dissection tools/knives even with stone edges, putting facets on gem stones, potters knives and scrapers, gardening tools (hoe, madox etc.), scissors, machine part faceting, farmers knives, factory de-burring knives, and the like.

Figure 15:
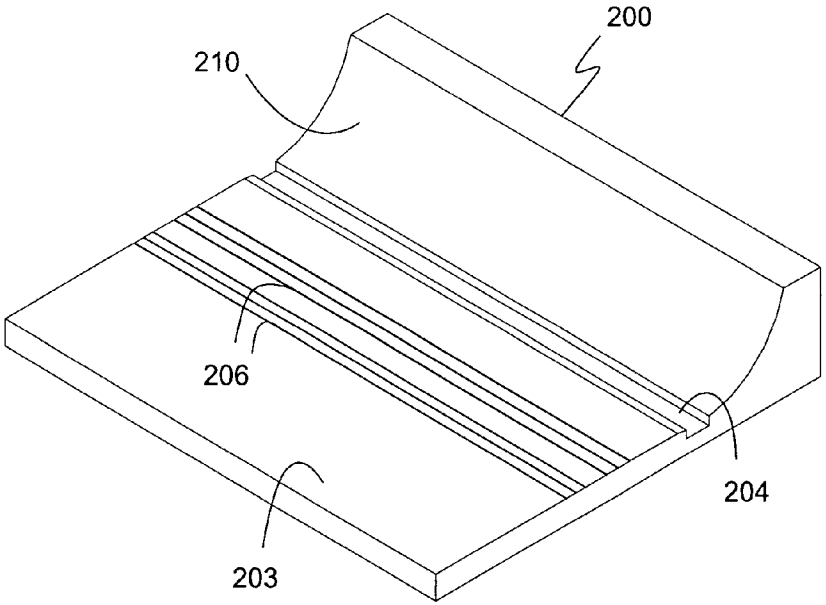
FIG. 15 is an enlarged perspective view of the angle dock component shown in FIG. 14.
Figure 16:
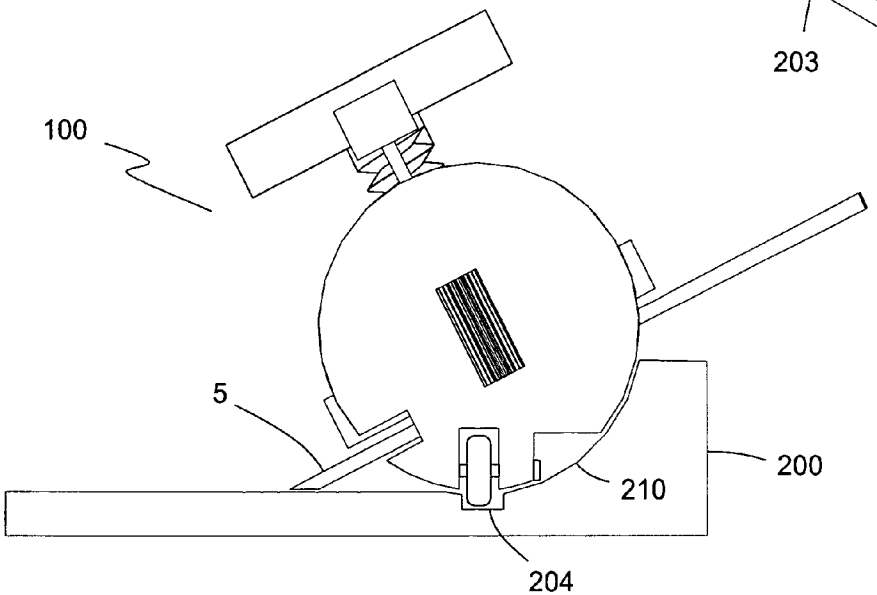
FIG. 16 is a side view of the angle dock shown component shown in FIG. 15.
Figure 14:
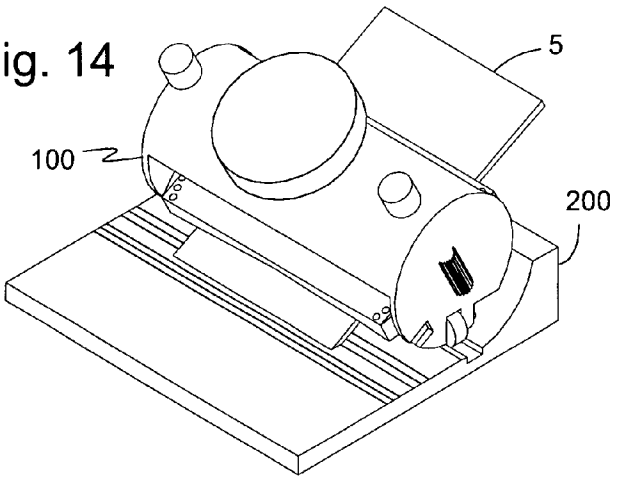
FIG. 14 is a perspective view of the embodiment of the present invention shown in FIG. 9 showing an angle dock component for setting the blade to be sharpened to the proper honing angle for the blade.

Turning now to FIG. 14, there is illustrated the sharpening holder 100 of the present invention mounted on an angle dock 200. Angle dock 200 is used for setting the proper clamping position of a cutting blade 5 within sharpening holder 100. Cutting blade 5 typically has a particular cutting edge angle. By aligning the cutting edge with the correct cutting angle indicia of angle dock 200 and fastening the cutting blade in the sharpening holder 100 insures the proper position for honing of the cutting edge of blade 5 at the proper angle. It should be understood that a cutting blade having a skewed cutting edge can be easily honed by adjusting the skew angle with the fastening plate 132. FIG. 15 is a perspective view of the angle dock 200. Angle dock 200 has a radial surface 210 adjacent a back edge 202. Radial surface 210 has an arc shape substantially similar to the circumferential surface 126 of body 120. Angle dock 200 also includes a dock raceway 204 sized to accommodate the plurality of roller members 140. A plurality of honing angle indicators 206 are disposed onto or formed into angle dock surface 203 parallel to dock raceway 204. The placement of the plurality of honing angle indicators 206 are preset to the honing edge angles most commonly encountered on cutting edges of a cutting tool. These angles include, but are not limited to, 20°, 22°, 25°, 27°, 30°, 35°, 40°, and 45°. FIG. 16 is a side view of the angle dock 200 with sharpening holder 100 containing a cutting blade 5 mounted thereon. As can be seen, the relationship of the plurality of roller members 140, the circumferential surface 126 of body 120 and the placement of the honing edge of blade 5 is more clearly illustrated. Angle dock 200 provides the advantages of (1) more accurately setting the cutting blade 5 in sharpening holder 120 at the proper position for the particular honing angle in the cutting edge of blade 5 and (2) a simple visual set-up and verification mechanism for setting the blade to the desired honing angle.

Figures 17, 18, 19:
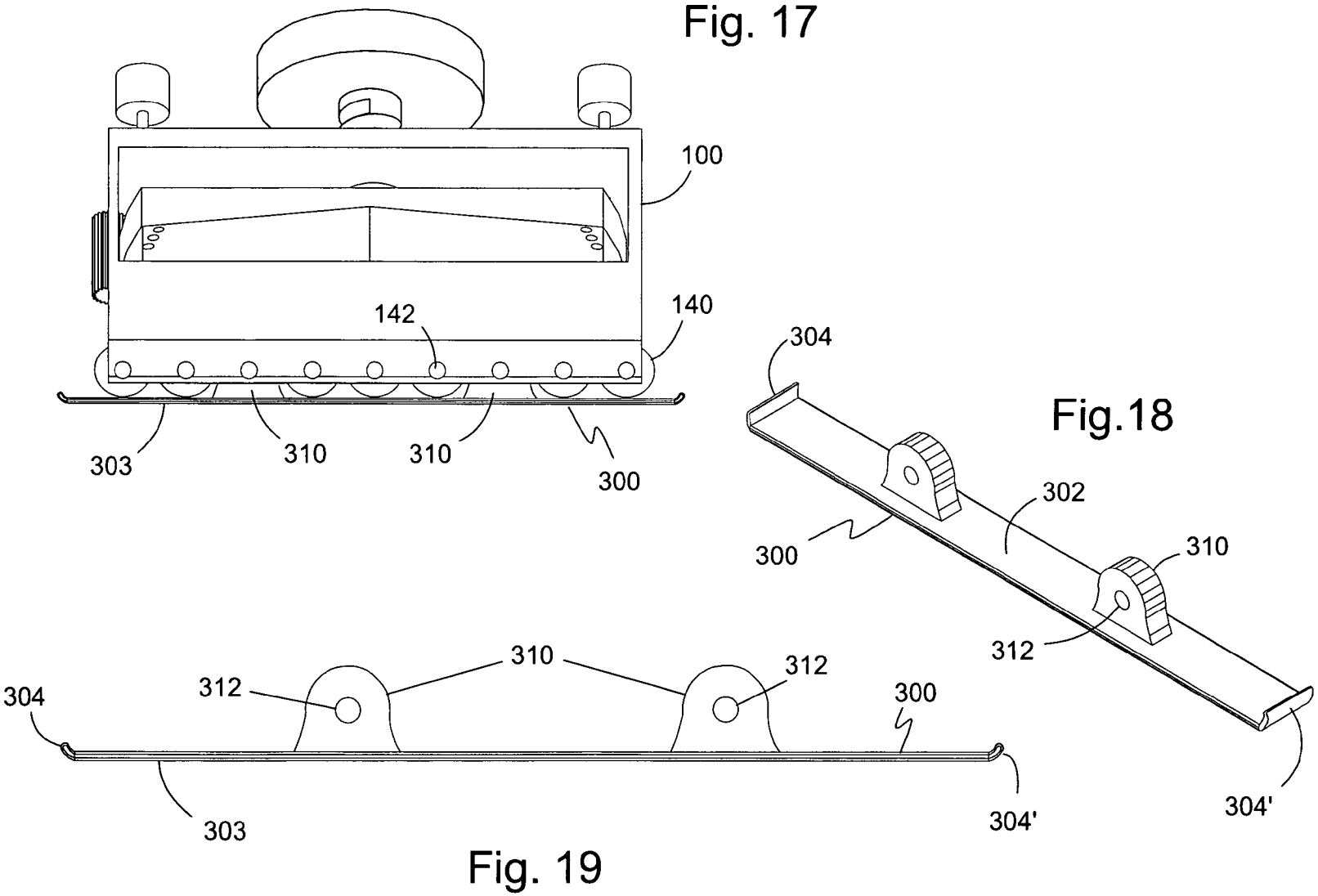
FIG. 17 is a back perspective view of the present invention in FIG. 9 showing a honing sled attached by the axle of a rolling member.
FIG. 18 is a perspective view of the honing sled shown in FIG. 17.
FIG. 19 is a side view of the honing sled shown in FIG. 18.

FIGS. 17, 18 and 19 illustrate the use of a sharpening holder sled 300. FIG. 17 is a rear view of sharpening holder 100 with sharpening holder sled 300. In this embodiment, sled 300 is connected to sharpening holder 100 using an axle 142 of roller member 140. As seen in FIGS. 18 and 19, sled 300 has one or more sled ears 310 integrally connected to the top surface 302 of sled 300. Sled ears 310 have a through opening 312 sized to receive axle 142 of roller member 140. Sled 300 optionally includes curved ends 304 and 304' that curve back out of the plane of top surface 302. As discloses previously, sharpening holder sled 300 may also be configured as a slide bar that is insertable within the raceway. The slide bar may also be formed as part of the body with a special coating or layer attached to the surface of the slide bar that allows the body to slide over a honing surface without extensive wear to the slide bar. In the insertable sled/side bar embodiment, the sled/slide bar may have a simple shape such as a rectangular block that is insertable into the raceway of the body and secured thereto. The roller members would be completely removed and the sled/slide bar inserted into the raceway and secured. The sled/slide bar extends out of the raceway approximately the same distance as the roller members. The portion of the sled/side bar that extends out of the raceway may also be wider than the raceway.

To attach sled 300 to sharpening holder 100, only roller members 140 where sled ears 310 connect to sharpening holder 100 need be removed to accommodate sled ears 310. The remaining roller members 140 may or may not be removed. The use of sled 300 allows the sharpening holder 100 to be moved in a parallel and oblique sliding motion relative to the longitudinal axis of body 120 over the honing stone, which is more difficult to do with the plurality of roller members 140. A sled bottom surface 303 preferably has a low friction surface that is unaffected by honing oil, which is typically used when honing the cutting edge of a cutting tool.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A sharpening holder for manually-sharpening a cutting edge to be honed over a honing surface, the holder comprising:

a cylindrical body having a first end, a second end and an opening formed through the body between the first end and the second end, the opening having a tool support surface;

an adjustable clamping component having a rotatable fastening plate positioned within the opening wherein the fastening plate has a tool engaging surface to hold the tool against the tool support surface at a user-defined rotated skew angle relative to the tool support surface of the cylindrical body; and a plurality of roller members disposed within a longitudinal raceway formed in a lower portion of the body below the opening wherein the plurality of roller members are aligned parallel to the longitudinal axis of the cutting edge to be sharpened and wherein the axis of rotation of the plurality of roller members is perpendicular to the longitudinal axis of the cutting edge to be sharpened.

2. The holder of claim 1 wherein the fastening plate has a plurality of skew angle indexing openings formed in opposite, peripheral ends of the fastening plate wherein a skew angle pin is removably connected to the body and received into one of the plurality of skew angle indexing openings.

3. The holder of claim 2 wherein the fastening plate has a top surface with a plurality of skew-angle indicia.

4. The holder of claim 1 further comprising a fine adjustment component rotatably disposed at one end of the body, the fine adjustment component being operationally connected to a peripheral end of the fastening plate.

5. The holder of claim 1 wherein the raceway is angled to the tool support surface of the body.

6. The holder of claim 1 wherein the plurality of roller members are selected from the group consisting of wheels, ball bearings, cylindrical rollers, and tapered rollers.

7. The holder of claim 1 wherein the tool engaging surface of the fastening plate has recessed portion with a plurality of parallel steps.

8. The holder of claim 1 wherein the body has a pair of aligned notches in the first end and the second end adjacent to the tool support surface nearest the plurality of roller members.

9. The holder of claim 1 further comprising a sled connected to the raceway.

10. The holder of claim 1 further comprising an angle dock having a channel for receiving the plurality of roller members to position the holder for adjustably setting a cutting blade to be sharpened in the holder.

11. The holder of claim 10 wherein the angle dock has a plurality of cutting edge angle indicia adjacent to a parallel to the channel.

12. A method of manually-sharpening a cutting edge on a tool to be honed over a honing surface, the method comprising:

mounting the tool with a cutting edge into a blade sharpening holder having a plurality of roller members mounted to a lower portion of the blade sharpening holder;

adjusting a skew angle of a fastening plate that holds the tool by rotating the fastening plate and the tool relative to a tool support surface of the blade sharpening holder;

placing the plurality of roller members and the cutting edge of the tool onto a honing surface; and moving the blade sharpening holder along the honing surface causing the cutting edge of the tool to slide parallel along the honing surface instead of perpendicular to the honing surface.

13. The method of claim 12 further includes adjusting the angle of the blade sharpening holder to the honing surface.

14. The method of claim 12 further includes adjusting the extension of the tool out of the blade sharpening holder by placing the blade sharpening holder with the tool onto an angle dock and aligning the cutting edge of the tool with a cutting edge angle indicia that matches the cutting edge angle of the cutting edge of the tool.

15. The method of claim 12 further comprising forming a V-shaped recess in the tool engaging surface of the fastening plate wherein the tool engaging surface has a plurality of parallel steps.

16. A method of making a blade sharpening holder for hand-sharpening of a cutting edge to be honed over a honing surface, the method comprising:

forming a cylindrical body with a tool support surface between a first end and a second end and a raceway in an outside surface of the cylindrical body between the first end and the second end;

mounting a plurality of roller members in the raceway of the cylindrical body wherein the rotational axis of the plurality of roller members is perpendicular to the longitudinal axis of the cylindrical body; and forming an adjustable fastening component having a rotatable fastening plate with a tool engaging surface sized for placement over the tool support surface to hold a tool having the cutting edge wherein the tool is against the tool support surface and wherein the rotatable fastening plate is rotatable relative to the tool support face for selecting a user-defined skew angle.

17. The method of claim 16 further comprising forming a plurality of skew angle indicia on a top surface of the rotatable fastening plate relative to a skew angle index on the cylindrical body.

18. The method of claim 16 further comprising forming a plurality of skew angle indexing openings in opposite, peripheral ends of the fastening plate wherein a skew angle pin is removably connected to the body and received into one of the plurality of skew angle indexing openings.

19. The method of claim 16 further comprising forming a fine adjustment component rotatably disposed at one end of the body, the fine adjustment component being operationally connected to a peripheral end of the fastening plate.

20. The method of claim 16 further comprising forming a pair of aligned notches in the first end and the second end of the cylindrical body adjacent to the tool support surface nearest the plurality of rollers.

* * * * *